United States Patent [19]

Kemeny

[11] Patent Number: 4,679,484

[45] Date of Patent: Jul. 14, 1987

[54] ELECTROMAGNETIC LAUNCHER RAIL TEMPERATURE REDUCTION THROUGH CONTROLLED BREECH CURRENT INJECTION

[75] Inventor: George A. Kemeny, Wilkins Township, Allegheny County, Pa.

[73] Assignee: Westinghouse Electric Corp., Pittsburgh, Pa.

[21] Appl. No.: 638,329

[22] Filed: Aug. 6, 1984

[51] Int. Cl.[4] ..... F41F 1/02

[52] U.S. Cl. ..... 89/8; 124/3; 310/12

[58] Field of Search ..... 89/8; 124/3; 310/10–14; 307/106–108, 246, 270; 318/135; 361/58, 8, 13; 323/901, 908

[56] References Cited

U.S. PATENT DOCUMENTS

| | | | |
|---|---|---|---|
| 3,112,435 | 11/1963 | Barney | 323/908 X |
| 3,534,226 | 10/1970 | Lian | 361/13 X |
| 3,873,854 | 3/1975 | Lamb | 361/58 X |
| 4,236,198 | 11/1980 | Ohsawa et al. | 323/908 X |
| 4,355,561 | 10/1982 | Kemeny et al. | 89/8 |
| 4,369,691 | 1/1983 | Baehr, Jr. et al. | 89/8 |
| 4,369,692 | 1/1983 | Kemeny | 89/8 |
| 4,426,562 | 1/1984 | Kemeny | 89/8 |
| 4,433,607 | 2/1984 | Kemeny | 89/8 |
| 4,467,696 | 8/1984 | McNab et al. | 310/12 X |
| 4,572,964 | 2/1986 | Honig | 124/3 X |

OTHER PUBLICATIONS

E. M. Honig, "Progress in Developing Repetitive Pulse Systems Utilizing Inductive Energy Storage", 4th IEEE Pulsed Power Conference, Albuquerque, NM, Jun. 6–8, 1983.

E. M. Honig, "Switching Considerations and New Transfer Circuits for Electromagnetic Launch Systems", IEEE Transactions on Magnetics, vol. 20, No. 2, Mar. 1984.

*Primary Examiner*—Deborah L. Kyle
*Assistant Examiner*—John E. Griffiths
*Attorney, Agent, or Firm*—R. P. Lenart

[57] ABSTRACT

The electromagnetic projectile launching systems of this invention accelerate projectiles by switching current from a current source to a pair of conductive projectile launching rails such that current flows through the rails and through an armature between the rails to produce an accelerating force on a projectile and the rate of current injection into the rails is controlled so that the initial projectile acceleration occurs at a reduced current level compared to the current used for subsequent projectile acceleration. This reduced current level is provided by initially shorting a resistor connected between one of the rails and the power source or alternatively by inserting a resistor in series with a switch which partially commutates current from the current source to the projectile launching rails. The maximum rail surface temperature during a launch is reduced by controlling the rate of initial current injection.

4 Claims, 3 Drawing Figures

ELECTROMAGNETIC LAUNCHER RAIL TEMPERATURE REDUCTION THROUGH CONTROLLED BREECH CURRENT INJECTION

BACKGROUND OF THE INVENTION

This invention relates to electromagnetic projectile launching systems and more particularly to such systems which include means for controlling the initial rate of current injection into a pair of projectile launching rails.

Electromagnetic launchers accelerate projectiles by passing a large current through a pair of projectile launching rails and an associated sliding conductive armature mounted between the rails. This current flow results in an accelerating force on the armature which can be used to propel an associated projectile along the conductive rails. Because of the massive currents involved and the initially low armature velocity, excessive heat may be locally generated in the rails, particulary near the breech region, during the initial moments of armature acceleration. This excessive heat generation can result in melting of the rail surface material which will quickly deteriorate the rail contact areas.

Computer calculations have shown that substantially lower breech rail surface temperatures will result if a projectile armature is already moving at a low velocity before flow of the propelling current commences. The primary reason for these lower surface temperatures is that at peak current, the rails and armature are subjected, at their interface, to a peak thermal flux for a given time period which is dependent upon the residence time of the armature. For faster armature movement, the rail surfaces experience this thermal flux for a shorter time and, therefore, the rails are subject to a lower surface temperature rise.

Lowering the maximum rail surface temperature will increase the life of the rails and barrel, and it is particularly important to prevent the possibility of temperature excursions to the melting point of the rail surface material. Launchers have been proposed in which a resistor is connected in series with the projectile launching rails to prevent excessive premature heating of the armature and to prevent premature armature movement during the period when current builds up in an inductive type current source. Examples of these launchers can be found in U.S. Pat. No. 4,355,561, issued Oct. 26, 1982 to Kemeny et al. and U.S. Pat. No. 4,369,691, issued Jan. 25, 1983 to Baehr, Jr. et al. The disclosures of these Patents are hereby incorporated by reference.

SUMMARY OF THE INVENTION

An electromagnetic projectile launching system constructed in accordance with this invention comprises: a pair of conductive rails; means for conducting current between the rails and for propelling a projectile along the rails; a source of electric current; a resistor electrically connected between one of the rails and the current source; means for switching current from the current source to the rails and the resistor; and means for shorting the resistor before current is switched by the switching means, thereby providing a first current level to the rails to produce initial movement of the projectile prior to the switching of a second and larger current level to the rails by the switching means.

In an alternative embodiment, a second resistor can be added in series with the switching means and a switch can be connected across this resistor such that the switch may be opened to provide a first magnitude of current flow to the rails to initially accelerate the projectile and the subsequent operation of the means for switching current would then switch a second and larger current magnitude to the rails to provide the final projectile acceleration.

The electromagnetic projectile launching systems of this invention accelerate a projectile by a method comprising the steps of: switching current from a current source to a pair of conductive projectile launching rails such that current flows through the rails and through a means for conducting current between the rails, thereby producing an accelerating force on the projectile; and controlling the rate of current injection into the rails such that initial projectile acceleration occurs at a reduced current level compared to the current level used for subsequent projectile acceleration, thereby limiting the temperature rise in the rails to less than a predetermined value.

DESCRIPTION OF THE PREFERRED EMBODIMENTS

Figure 1:
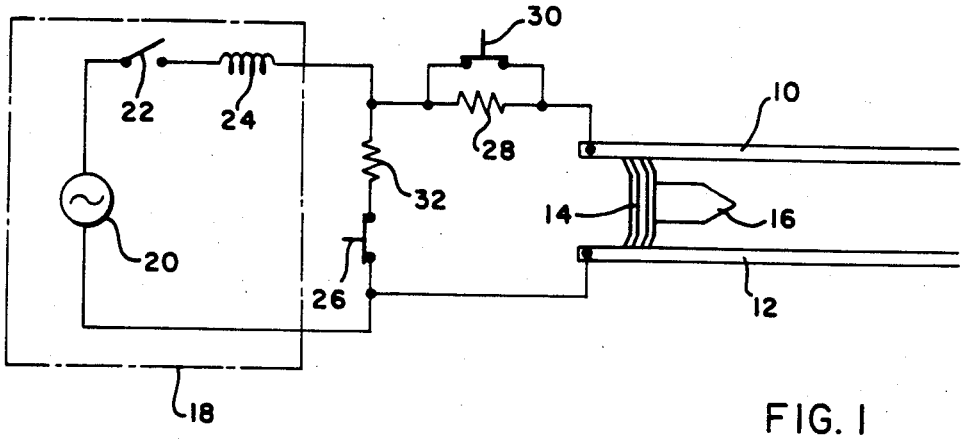
FIG. 1 is a schematic diagram of an electromagnetic projectile launching system constructed in accordance with one embodiment of the present invention.

Referring to the drawings, FIG. 1 is a schematic diagram of an electromagnetic launching system constructed in accordance with one embodiment of this invention. This system includes a pair of generally parallel conductive projectile launching rails 10 and 12 and a sliding conductive armature 14 located between the rails which serves as a means for conducting current between the rails and for propelling projectile 16 along the rails. The projectile launching rails are connected to a current source 18 which comprises the series connection of a generator 20, a switch 22 and an inductive energy storage device 24. A high current switch 26 is connected across the rails and serves as means for switching current from the current source to the rails. A resistor 28 is connected between the current source and one of the rails and is sized such that during inductor charging, the breech current through the rails and the armature will be so low as to neither cause excessive armature heating nor premature armature acceleration. Switch 30 is connected across resistor 28 and serves as means for shorting out this resistor. By closing switch 30 a precise number of milliseconds before the opening of switch 26, for example 3 or 4 ms earlier, some pre-acceleration at a low current can be obtained. A very low resistance 32 in series with switch 26 can hasten and more precisely control the level of the initial breech current which will start to flow when switch 30 is closed. If resistor 32 is not required, then the FIG. 1 configuration will be more efficient than the launcher disclosed in the previously cited U.S. Pat. No. 4,355,561 since the pre-acceleration at the initial low current level reduces energy losses in switch 26 while it is still closed. The switching duties of switch 30 are very moderate compared to those of switch 26, which will have to be far more massive. Switch 30 closes at a voltage across its contacts of ony a few volts and can be opened after current flow has completely ceased. Its $I^2t$ capability need only accommodate the firing and decay current transients, and not the far more severe and long duration charging current transient. It is, of course, the charging current flowing through resistor 32 which reduces system energy efficiency.

Figure 2:
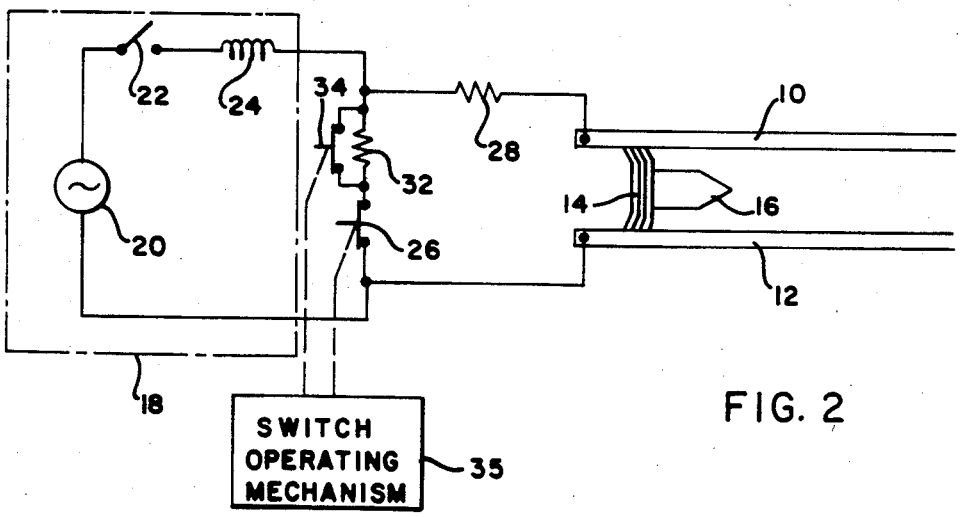
FIG. 2 is a schematic diagram of an alternative embodiment of this invention.

The schematic diagram of FIG. 2 shows an alternative embodiment wherein initial acceleration at an intermediate current level is obtained by placing a switch 34 across resistor 32. After opening switch 34, the voltage drop across resistor 32 commutates a fraction of the current into the launcher rail breech. A brief time of, for example, a few milliseconds thereafter, switch 26 is opened to complete current commutation into the breech. This type of system would give a very precise two-step current rise. In this configuration, switches 26 and 34 may be mechanically connected through switch operating mechanism 35, to synchronise their opening sequences or they may be a single switch with one set of contacts which opens before the second set. In the system of FIG. 2, current commutation into the breech is initially caused by opening switch 34, thereby causing a relatively low current to flow through resistor 28 and finally be opening switch 26 to commutate the full launch current into the rails. By splitting the commutation duties, each of the two switches will be advantageously subjected to less arcing damage.

Another alternative embodiment is of entirely eliminate switch 26 in FIG. 2 and let resistor 32 have a highly temperature dependent resistance. In this case, after switch 34 is opened, resistor 32 initially has a low resistance which aids commutation of current into the resistor and, thereafter, it rapidly heats up and through its increase in resistance, rapidly and progressively injects current into the launcher rail breech. In this manner of operation, resistor 32 remains in the circuit during firing, but if its resistance gets high enough, its parasitic current can be quite acceptable. By closely coupling switch 34 and resistor 32, the inductance of the loop can remain very low which will greatly reduce the switch commutation severity and its arc contact area deterioration.

The launching systems of FIGS. 1 and 2 electromagnetically accelerate a projectile by a method which comprises the steps of: switching current from a current source to a pair of conductive projectile launching rails such that current flows through the rails and through a means for conducting current between the rails, thereby producing an accelerating force on a projectile; and controlling the rate of current injection into the rails such that initial projectile acceleration occurs at a reduced current level compared to the current level used for subsequent projectile acceleration, thereby limiting the rail surface temperature rise in the rails to less than a predetermined value.

Figure 3:
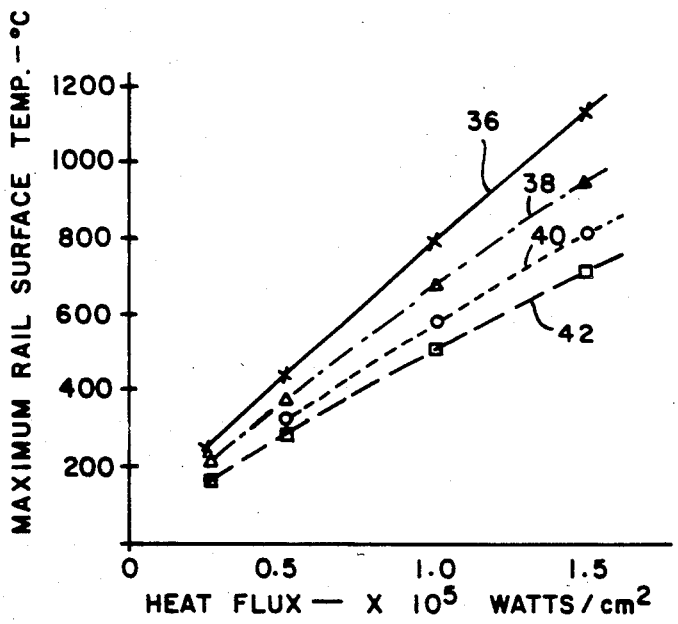
FIG. 3 is a series of curves which illustrate that rail surface temperature reduction is achieved by providing initial armature velocity.

FIG. 3 is a graph which illustrates the computed maximum rail surface temperatures for a particular parallel rail launcher using an acceleration current of 4 megamperes which rises to its peak value in 1 millisecond and thereafter drops to half its peak value in another 14 ms. Curve 36 represents the maximum rail surface temperature when the initial projectile velocity is zero. Curves 38, 40 and 42 represent the rail temperatures for initial projectile velocities of 10, 50 and 100 m/sec, respectively. These curves clearly show the reduction in maximum rail surface temperature which can be achieved by providing an initial projectile velocity or pre-acceleration prior to the injection of the propelling current. For example, at an assumed armature-rail interface flux of $1.5\times10^5$ w/cm$^2$, as shown by curve 42 an initial velocity of 100 meters per second resulted in a computed lowering of the maximum rail surface temperature by about 425° C. which in the example case results in a lowering of the rail temperature from about the melting point of copper to well below it. Although the assumed conditions on which the curves of FIG. 3 were calculated required that a secondary pre-acceleration system was used to provide the initial projectile acceleration prior to the injection of the propelling current, these curves have been included to indicate that it is advantageous to have a lower contact heat flux for a given current and armature velocity, as this will consistently result in lower maximum rail surface temperature.

If it is now assumed that the armature-to-rail contact resistance remains substantially unchanged and independent of current, then the heat flux due to this resistance is directly proportional to the square of the armature current. Likewise, the constriction resistance dissipation in the rails will be about proportional to the current squared and thus it is reasonable to conclude that the maximum temperature rise in the rails, everything else being equal, will be about proportional to the current squared. If, instead, the contact voltage drop is assumed to be constant and independent of current, then the temperature rise due to this constant contact voltage drop would only be directly proportional to current, instead of current squared, but the heating due to constriction resistance will still be proportional to current squared. Therefore, in order to be conservative, the following approximate calculations assume that the heat flux at the contact area is only directly proportional to the current and in order to estimate temperature rises, that at a 4 MA propulsion current and at the assumed constant contact voltage drop, the heat flux is equal to $1.5\times10^5$ watts/cm$^2$.

From the above assumptions, it follows that at, for example, 2 MA, the heat flux would be roughly equal to 0.75 w/cm$^2$ or ½ of the 4 MA magnitude. From FIG. 3 and curve 36 at $0.75\times10^5$ w/cm$^2$, the maximum rail temperature would rise to a very acceptable value of very roughly 600° C. and as the projectile velocity increases at the 2 MA armature current, the rail temperature just behind the armature would rapidly decrease. When the projectile reaches a velocity of about 100 m/sec, the armature current could then be increased to 4 MA without ever extending a quite acceptable 715° C. temperature level at the $1.5\times10^5$ w/cm$^2$ and 100 meter per second operating point of curve 42 of FIG. 3. Thus, in a preliminary manner, it is shown that a two-step rise in current can achieve the 100 meter per second operating point without ever exceeding the maximum rail temperature which would result by using an external projectile injection scheme to obtain the 100 meter per second velocity at the start of current flow. In other words, this invention has eliminated the need for an auxiliary system to achieve a pre-injection velocity by forcing a slower and controlled projectile current rise. A corollary which follows from this analysis is that with an appropriately slow rise of current, it may also be feasible to operate well above 4 MA without excessive rail temperatures through a strategy of only achieving, for example, 6 MA at a point in the rails where the projectile velocity is well above 100 m/sec.

It can now be shown that controlling the rate of current injection does not have significantly adverse effects on current commutation into the breech, efficiency, or muzzle velocity. For the sake of comparison, it can be assumed that a prior art arc commutation result in a current rise to 4 MA in one millisecond and that the current is injected into the breech or loop of an inductance equal to 0.2 μH. As a rough approximation, using the equation $V=L\,di/dt$ and assuming loop ohmic resistance voltage drops to be negligible, a constant arc voltage of 800 volts is required and the commutation arc energy dissipation will be $V_{arc}\,I_{max}\,\Delta T/2$ which is 1.6 Mj and which is also exactly equal to $\frac{1}{2}\,LI^2$ where $L=0.2$ μH, the loop inductance. The 1.6 Mj appears to be a significant magnitude of energy, but assuming an artillery application involving a 50 kg mass accelerated to 775 m/sec, this yields a projectile kinetic energy of 15 Mj. If the overall system has an efficiency of 20%, then the total energy per shot is 75 Mj and the commutation arc energy represents only 2.1% of the energy loss in the whole system. Thus, relative to the total per shot energy magnitude, the commutation arc energy dissipation is quite acceptable.

Now for the slower current rise as would occur in accordance with this invention, assume that the projectile current rises linearly to 4 MA in 4 ms and that the inductance of the new loop into which current is commutated is again 0.2 μH. If the breech current rises linearly to 4 MA in 4 ms, then the not yet commutated current will drop linearly from 4 MA to zero in the same 4 ms. Next, assume that the commutation is achieved by suitably adding resistance in such a manner that the voltage across the resistance, which drives the commutation, rises linearly during the same 4 ms. In that case, because of the longer commutation time, the maximum voltage across the resistor need only to be 400 volts and by calculating the integral of the product of voltage and current with respect to time across the resistor, an energy dissipation of about 1.1 Mj is obtained. Thus, this invention results in less energy loss compared to that required for the prior art rapid commutation scheme. It can, therefore, be seen that causing a slower rate of rise of current need not increase commutation energy expenditure.

In an actual launching system, the required addition of series resistance to obtain a slower rate of current commutation can be accomplished by using a massive rail or rotating switch 26 in FIGS. 1 and 2, wherein movement of the armature first adds series resistance by using, for example, resistive rails and after 4 ms, metallic conduction ceases and the resulting arcing can complete commutation. Alternatively, using the FIG. 2 configuration, after opening switch 34, resistor 32 can progressively heat up and its temperature-resistance variation can be such as to yield the required resistance change. Switch 26 may finally be opened to commutate any remainder of the current.

It can next be shown that the slower rate of rise of breech current in the launchers of this invention will not introduce excessive inductance due to projectile displacement, as such an inductance increase would make commutation more difficult. For ease in calculation, assume again that the current rises linearly from 0 to 4 MA in 4 ms, that the projectile mass is 50 kg, that friction is negligible, and that the barrel has an inductance gradient of 0.5 μH/m. Under these assumptions, and only during the initial 4 ms, the current and the projectile motion can be expressed as simple functions of time where t is the time in seconds from current initiation. These functions are as follows: current $i=10^9t$ amperes; acceleration $a=5\times10^9t^2$ $m/s^2$; distance traveled $s=416.7\times10^6t^4$ $m$; force $F=250\times10^9t^2$ newton; and velocity $V=1.667\times10^9t^3$ $m/s$.

Based on these relationships, the current will reach 2 MA in 2 ms, at which time the projectile will be moving at 13.3 m/s and will have traversed only 0.7 cm from its starting position. As a very rough estimate from the curves of FIG. 3, with the flux assumed to be $0.75\times10^5$ w/cm$^2$, the maximum rail temperature would be only about an acceptable 600° C. or less. At the 4 ms assumed end of commutation, the velocity calculates to be 107 m/s and the distance travered would be 10.7 cm. Again, based on FIG. 3, but now at $1.5\times10^5$ w/cm$^2$, the estimated maximum rail temperature is below 700° C. Thus, by using a gradual current rise, the maximum rail surface temperature would be limited to the order of 700° C. without using a secondary and presumably non-electrical system to pre-accelerate the projectile.

It should next be noted that at 4 MA and 4 ms and thus the assumed end of commutation, the total projectile travel was calculated to be only 10.7 cm. With a barrel inductance gradient of 0.5 μH/m, the 10.7 cm displacement would result in a 0.05 μH increase of inductance of the loop into which current is being commutated. This inductance was conservatively assumed to be 0.2 μH and could thus well have included the inductance adder, but if it did not, the assumed 0.2 μH would have been higher by 0.05 μH or 25% for only a brief during the final commutation. Commutation would then simply take slightly longer. Actually, at 4 ms, metallic switch contact would be interrupted, an arc would be drawn and this arc would commutate the remainder of the not yet commutated current. From the above estimates, it can then be concluded that there would be no adverse effects on commutation due to ramping up of the breech current in 4 ms since projectile displacement is too small to substantially increase the inductance of the loop into which the current is being injected.

As a final step, it can now be shown that the effect on muzzle exit velocity due to a slower current rate of rise would be negligible. For the prior art system having a current rise to 4 MA in one millisecond and a relatively slow current decay, it can be assumed that the current briefly remains constant after reaching its maximum value. In that case, one can compute that the 50 kg projectile have reached a velocity of 26.7 m/s and traversed 0.7 cm in one millisecond and will have attained 107 m/s at the point where it has traversed a total of 7.3 cm. With the slower rate of current rise of this invention, for example, 4 MA in 4 ms, the same velocity of 107 m/s is attained at 4 ms and at a traverse of 10.7 cm. If it is now assumed that the projectile current variation in the remainder of the bore is the same for both cases, then in essence, the slower rate of current rise has resulted in a calculated bore length reduction of $10.7-7.3=3.4$ cm. To calculate the loss in velocity, it is only necessary to calculate the advantage gained by increasing the barrel length by 3.4 cm at the muzzle where the velocity would be 775 m/s and where the accelerating current would have dropped to, for example, an assumed 2 MA. Under these conditions, the additional 3.4 cm will be traversed by the projectile in 43.8 microseconds and during this time, the increase in velocity will be 0.9 m/s. This is an entirely negligible velocity loss when compared with the computed velocity of 775 m/s.

In summary, it has been shown that slowing the rate of current injection into the breech will not result in an increase in commutation energy requirements compared to the prior art practice of very rapid current injection. In addition, the maximum rail surface temperatures will be substantially lowered by a controlled and slower rate of rise of breech current. This slower current rise obviates the need for any secondary pre-acceleration system. Since the movement of the projectile to the point of completion of commutation involves a very short distance and, therefore, adds very little barrel inductance, the commutation performance should not deteriorate. Furthermore, a properly controlled and slower rate of current injection into the breech need not cause a measurable muzzle velocity reduction.

Although the present invention has been described in terms of what are at present believed to be its preferred embodiments, it will be apparent to those skilled in the art that various changes may be made without departing from the scope of the invention. It is, therefore, intended that the appended claims cover all such changes.

What is claimed is:

1. An electromagnetic projectile launching system comprising:

a pair of conductive rails;

means for conducting current between said rails and for propelling a projectile along said rails;

a source of electric current; and a resistor connected electrically in parallel with a switch to form a circuit which is electrically connected between said rails such that the opening of said switch commutates current from said current source to said rails, wherein said resistor is composed of temperature dependent resistive material which increases in resistance as its temperature rises, thereby increasing the current injected into said rails.

2. An electromagnetic projectile launching system comprising:

a pair of conductive rails;

means for conducting current between said rails and for propelling a projectile along the rails;

a source of electric current;

a first resistor electrically connected between one of said rails and said current source;

means for switching current from said current source to said rails and said first resistor; and means for shorting said first resistor before current is switched by said switching means, said means for switching having sufficient resistance to provide a first current level to said rails, when said first resistor is shorted, to produce initial movement of said projectile prior to the switching of a second larger current evel to said rails when said switching means opens, the magnitude of said second current being about twice the magnitude of said first current.

3. An electromagnetic projectile launching system as recited in claim 2, wherein said means for switching current from said current source to said rails comprises:

the series connection of a first switch and a second resistor.

4. An electromagnetic projectile launching system as recited in claim 3, wherein said means for shorting includes a second switch connected across said first resistor; and wherein the launching system further includes means for controlling the operation of said first and second switches such that said first switch opens after a preselected time interval following the closing of said second switch.

* * * * *